US007160046B2

(12) United States Patent
Paine

(10) Patent No.: US 7,160,046 B2
(45) Date of Patent: Jan. 9, 2007

(54) FASTENING SYSTEM

(76) Inventor: Leslie Paine, 12 Mandela Street, London (GB) SW9 6EL ( * ) Notice: Subject to any disclaimer, the term of this patent is extended or adjusted under 35 U.S.C. 154(b) by 454 days.

(21) Appl. No.: 10/690,753

(22) Filed: Oct. 21, 2003

(65) Prior Publication Data

US 2004/0081508 A1 Apr. 29, 2004

(30) Foreign Application Priority Data

Oct. 22, 2002 (GB) ..... 0224555.3

(51) Int. Cl.
*B42F 13/12* (2006.01)

(52) U.S. Cl. ..... 402/64; 402/500; 24/67 P; 24/67.1; 24/453

(58) Field of Classification Search ..... 402/7–8, 402/13, 25, 58–59, 64, 500; 281/27.3; 24/67 P, 24/67 R, 67.1, 67.9, 297, 453; D99/34; 40/124.05, 124.06, 537, 775–776; 229/92.9; 206/0.8, 0.82
See application file for complete search history.

(56) References Cited

U.S. PATENT DOCUMENTS

| | | | | | |
|---|---|---|---|---|---|
| 327,216 | A | * | 9/1885 | Adams | 24/56 |
| RE10,739 | E | * | 6/1886 | Stetson | 24/67 R |
| 395,771 | A | * | 1/1889 | Crane | 24/67.1 |
| 454,416 | A | * | 6/1891 | Albrecht | 206/482 |
| 618,497 | A | * | 1/1899 | Crabb | 229/92.9 |
| 717,957 | A | * | 1/1903 | Weaver | 402/70 |
| 747,087 | A | * | 12/1903 | Ruth | 229/84 |
| 756,712 | A | * | 4/1904 | De Saint Chamas | 24/67 R |
| 805,507 | A | * | 11/1905 | Watt | 402/65 |
| 919,622 | A | * | 4/1909 | McComb | 402/80 R |
| 935,767 | A | * | 10/1909 | Mentzer | 402/29 |
| 1,094,019 | A | * | 4/1914 | Reifel et al. | 402/28 |
| 1,107,351 | A | * | 8/1914 | Proudfit | 402/79 |
| 1,167,639 | A | * | 1/1916 | Eifel | 402/59 |
| 1,482,433 | A | * | 2/1924 | Hoffman et al. | 229/92.9 |
| 1,491,675 | A | * | 4/1924 | Conklin | 229/72 |
| 1,498,988 | A | * | 6/1924 | Battle | 281/50 |
| 2,153,575 | A | * | 4/1939 | Kramer | 402/19 |
| 2,848,163 | A | * | 8/1958 | Van Horne Serrell | 235/487 |
| 3,107,673 | A | * | 10/1963 | Haddad | 402/79 |
| 3,205,759 | A | * | 9/1965 | Texier | 411/44 |
| 3,315,683 | A | * | 4/1967 | Rodriguez et al. | 402/79 |
| 3,831,225 | A | * | 8/1974 | Bengtsson | 24/453 |
| 4,193,704 | A | * | 3/1980 | Miller et al. | 402/19 |
| 4,295,747 | A | * | 10/1981 | Errichiello | 402/75 |
| 4,307,972 | A | * | 12/1981 | Errichiello | 402/73 |
| 4,430,015 | A | * | 2/1984 | Nerlinger | 402/79 |
| 4,479,733 | A | * | 10/1984 | Segal | 402/79 |
| 4,534,671 | A | * | 8/1985 | Hafner | 402/80 R |

(Continued)

FOREIGN PATENT DOCUMENTS

EP 0 085 547 A1 8/1983

(Continued)

*Primary Examiner*—Monica Carter
*Assistant Examiner*—Eric A. Gates
(74) *Attorney, Agent, or Firm*—Sughrue Mion, PLLC

(57) ABSTRACT

A fastening system comprising a stud (10) and a sheet of cover material (16);

the stud (10) being formed with a groove (14), and the sheet of cover material (16) being formed with a hole (18) and two slits (20), the slits (20) extending away from respective intersections (22) with the hole (18) in respective directions which are not in alignment with one another;

whereby, in use, the stud (10) is pushed through the hole (18) until the groove (14) in the stud (10) snaps into engagement with the hole (18) in the sheet of cover material (16).

5 Claims, 3 Drawing Sheets

U.S. PATENT DOCUMENTS 4,572,380 A * 2/1986 Langwell ..... 211/57.1
4,595,309 A * 6/1986 Chinchar ..... 402/80 R
4,611,942 A * 9/1986 Morse ..... 402/79
4,832,207 A * 5/1989 Alexander ..... 211/57.1
5,113,553 A 5/1992 Hutchinson
5,165,721 A * 11/1992 Schwartz ..... 281/15.1
5,339,967 A * 8/1994 Valiulis ..... 211/57.1
5,405,209 A * 4/1995 Johns et al. ..... 402/28
5,433,546 A * 7/1995 Kershaw ..... 402/79
5,568,675 A * 10/1996 Asami et al. ..... 24/453
6,196,750 B1 * 3/2001 Hansen ..... 402/79
6,261,021 B1 * 7/2001 Pfanner et al. ..... 402/79
2002/0026693 A1 * 3/2002 Akema et al. ..... 24/453

FOREIGN PATENT DOCUMENTS

GB 1 250 163 10/1971
GB 1 443 113 7/1976

* cited by examiner

FASTENING SYSTEM

The present invention relates to a fastening system comprising a stud and a sheet of cover material and is more especially but not exclusively concerned with a fastening system for binding paper stationery or the like that has been pre-punched with round holes.

Binders for paper stationery are well known but suffer from several disadvantages—one disadvantage is that they are sold in a pre-assembled state, and are therefore bulky, and another disadvantage is that the pre-assembly steps are expensive.

Objects of the present invention are to tackle those disadvantages by providing a fastening system, capable of use in binding paper stationery that has been pre-punched with round holes, wherein the fastening system can be sold in a disassembled state but then assembled in a simple and convenient manner by an end user.

According to the present invention, a fastening system comprises a stud and a sheet of cover material;

the stud being formed with a groove, and the sheet of cover material being formed with a hole and two slits, the slits extending away from respective intersections with the hole in respective directions which are not in alignment with one another;

whereby, in use, the stud is pushed through the hole until the groove in the stud snaps into engagement with the hole in the sheet of cover material.

It will be appreciated that a binder can be formed from the combination of one or more of the studs being snapped into engagement with one or more of the sheets of cover material.

Preferably, the sheet of cover material is formed of a plastics material such as polyurethane, polypropylene or polyethylene, but could be formed of paper, card, wood, leather or metal.

The deformability of the sheet of cover material, coupled with the spring-back property of the sheet of cover material, creates the ability for the stud to snap into engagement with the sheet of cover material.

Preferably, the slits diverge with increasing distance from the hole to form a flap.

Preferably, the slits are tangential to the hole, and the hole has a boundary, with a part of the boundary of the hole which is a continuation of the tangential slits including part of a circle, and with a remaining part of the boundary of the hole forming part of a circle of greater radius than said circle included in said part of the boundary of the hole which is a continuation of the tangential slits.

It is believed that the above-noted configuration of the hole and two slits is particularly effective in gripping the stud. Typically, the part of the boundary of the hole which is a continuation of the tangential slits has a curved base with a radius corresponding to that of the groove in the stud. The remaining part of the boundary of the hole also engages the groove in the stud and thereby firmly holds the stud in position within the hole in the sheet of cover material.

Preferably, the stud is of metal and the groove is an annular groove.

More particularly, the stud may be elongate and have an annular groove near each end and the sheet of cover material may be folded and have said hole and two slits on one side of said fold and have another of said hole and two slits on the other side of said fold whereby, in use, each of the annular grooves snaps into engagement with a respective one of each of the holes.

Preferably, the stud passes through pre-punched holes in paper stationery located between the annular grooves in the stud.

The diameter of the stud may be slightly smaller than the diameter of the pre-punched holes in the paper stationery allowing the paper stationery to slip easily over the stud. There are commonly found hole sizes of 6 mm, ¼" and 5⁄16". It would be possible for the stud to have a small diameter barrel over which a sleeve could be introduced to bring the portion of the stud that passes through the paper stationery up to the diameter of larger pre-punched holes.

The ends of the stud may be domed to act as lead-ins.

Moreover, the stud may be symmetrical so that either end can be gripped without requiring to be correctly orientated—this can be important when the fastening system is to be assembled post purchase by an end user.

The fastening system may be of use in a number of different binder formats. For example, there may be a one-piece cover formed by folding a single sheet of cover material, with a series of studs of different height being provided to suit the contents of the binder. A fastening system may bind together particular documents which are then further held in a traditional ring binder. Moreover, the fastening system would also be suitable for use in swatch binding where there is a single stud around which the swatch sheets can pivot.

In all of these applications the fastening system may be easily assembled and disassembled at will.

A fastening system in accordance with the present invention will now be described in more detail by way of example only with reference to the accompanying drawings in which.

A fastening system in accordance with the present invention is shown in the accompanying drawings.

Figure 1:
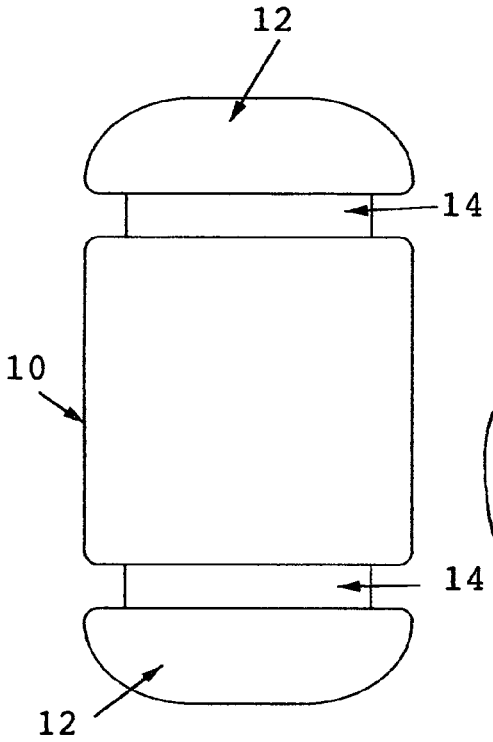
FIG. 1 is a side view of a stud.

More particularly, FIG. 1 shows an elongate metal stud 10. The stud 10 has a domed lead-in 12 at each end and has an annular groove 14 near each end. The stud 10 is not only rotationally symmetrical but the ends are mirror images to allow use of either of the annular grooves 14.

Figure 2:
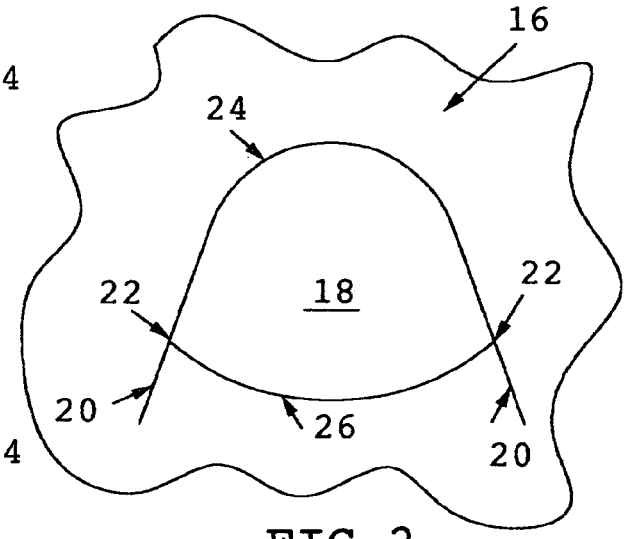
FIG. 2 is a plan view of part of a sheet of cover material.

FIG. 2 shows part of a sheet 16 of cover material which has been formed with a hole 18 and two slits 20. The slits 20 extend away from respective intersections 22 with the hole 18 in respective directions which are not in alignment with one another. The slits 20 diverge with increasing distance from the hole 18. The slits 20 are tangential to the hole 18 with a part 24 of the boundary of the hole 18 including part of a circle. The part 24 of the boundary of the hole 18 is a continuation of the tangential slits 20. A remaining part 26 of the boundary of the hole 18 forms part of a circle of greater radius than said circle included in said part 24 of the boundary of the hole 18.

The cover material of the sheet 16 is preferably a plastics material such as polyurethane, polypropylene or polyethylene, but could be formed of paper, card, wood, leather or metal.

Figure 3:
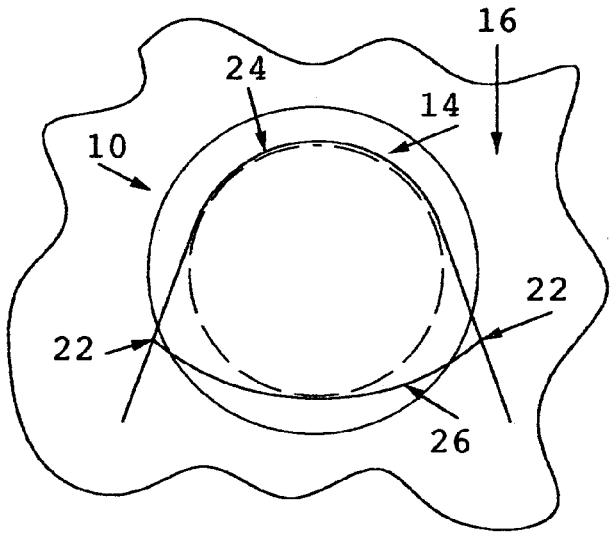
FIG. 3 is a schematic cross-sectional view indicating the interengagement between a stud and part of a sheet of cover material.

FIG. 3 shows schematically the positions which are adopted by the stud 10 and the sheet 16 after the stud 10 has been brought into snap engagement with the sheet 16.

More particularly, it will be seen that the part 24 of the boundary of the hole 18 lies snugly against the base of one of the grooves 14 in the stud 10. The radial extent of said abutment may be around 160°. The remaining part 26 of the boundary of the hole 18 tangentially touches the diametrically opposed part of the base of the groove 14 of the stud 10.

For ease of flexing, and subsequent snap engagement, the intersections 22 are preferably located just beyond the open outer edge of the groove 14 in the stud 10.

It has been found that if the stud 10 is pushed too far through the sheet 16, the remaining part 26 of the boundary of the hole 18 remains in engagement with the groove 14, and the natural tendency of the sheet 16 to return to an undeformed condition pulls the stud 10 back into the intended position of engagement.

Figure 4:
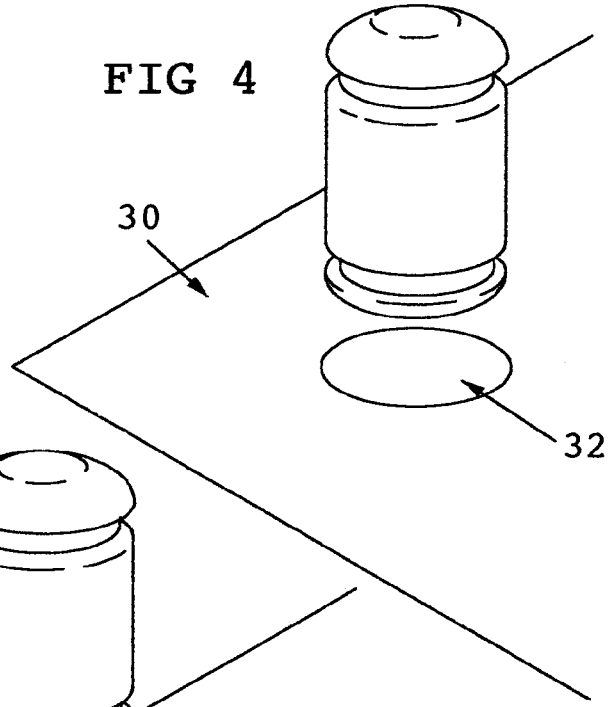
FIG. 4 is a perspective view indicating a stud with a paper sheet having a small diameter pre-punched hole.
Figure 5:
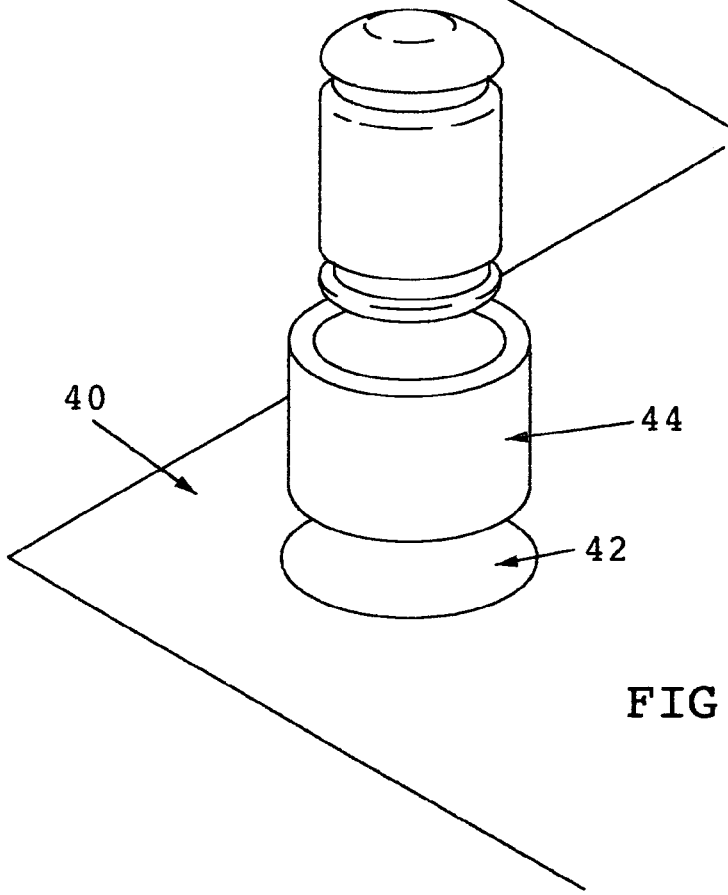
FIG. 5 is a perspective view indicating a stud with a sleeve allowing use with a paper sheet having a large diameter pre-punched hole.

In the intended use as a binder with paper stationery, a plurality of paper sheets are located around the central part of the stud 10 between the two annular grooves 14 FIG. 4 shows a paper sheet 30 with a pre-punched hole 32, whereas FIG. 5 shows a paper sheet 40 with a pre-punched hole 42 which is of greater diameter than the pre-punched hole 32, the gap which would have otherwise have been formed being filled by a sleeve 44.

Figure 6:
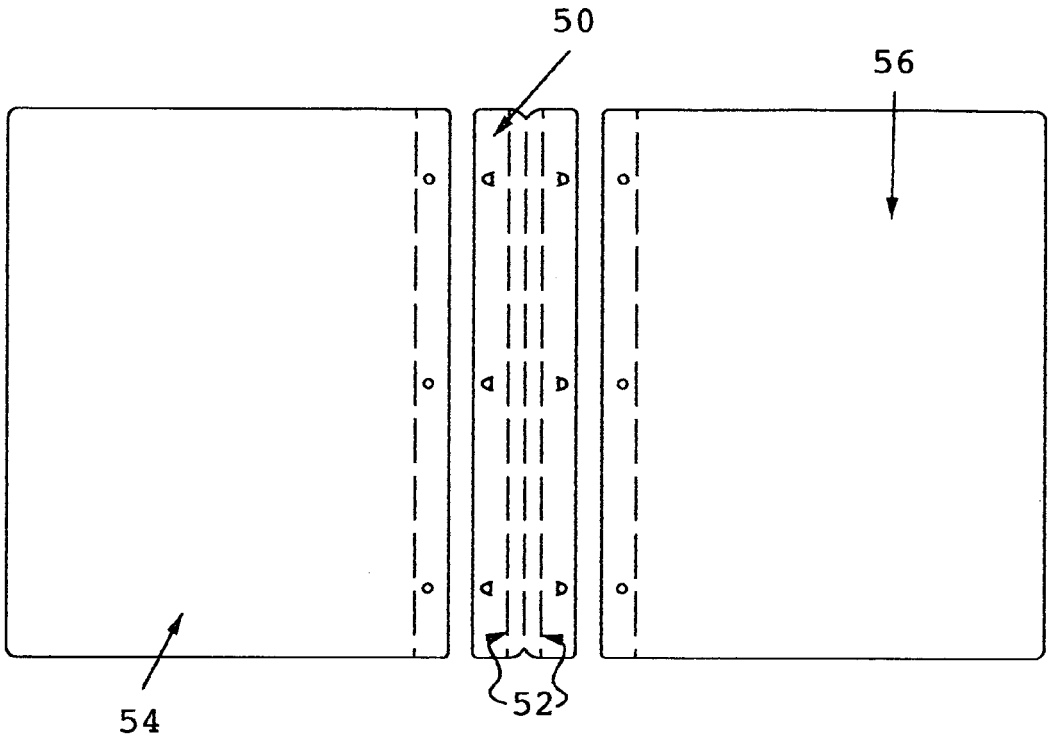
FIG. 6 is a plan view showing a binder with two covers and a central foldable sheet of cover material.
Figure 7:
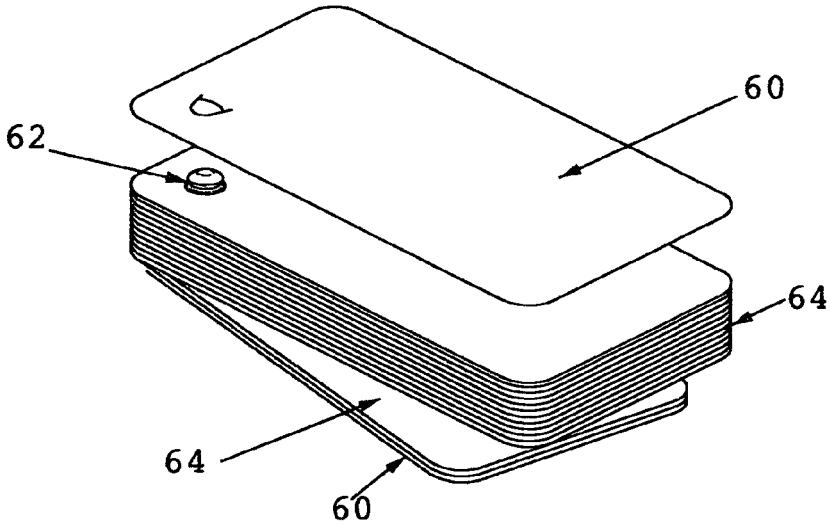
FIG. 7 is a perspective view of a fastening system in the form of a swatch binding.

Although many different applications are possible, two preferred applications will now be illustrated merely by way of example—FIG. 6 shows a sheet 50 of cover material with central fold lines 52 as well as a separate front cover 54 and a separate rear cover 56, whereas FIG. 7 shows two sheets 60 of cover material with a single stud 62 holding a number of separate swatches 64.

In both of FIGS. 6 and 7, the fastening system incorporates those as previously described with reference to FIGS. 1 to 5.

I claim:

1. A fastening system comprising a stud and a sheet of cover material; the stud being formed with a groove, and the sheet of cover material being formed with a hole and two non-aligned tangential slits, that diverge with increasing distance from the hole, wherein the hole has a boundary, and a part of the boundary of the hole which is a continuation of the tangential slits includes part of a first circle; wherein a remaining part of the boundary of the hole forms part of a second circle of greater radius than said first circle; and whereby, in use, the stud is pushed through the hole until the groove in the stud snaps into engagement with the hole in the sheet of cover material.

2. A fastening system according to claim 1, wherein the stud is of metal and the groove is an annular groove.

3. A fastening system according to claim 2, wherein the stud is elongate and has an annular groove near each end, and the sheet of cover material is folded and has said hole and two slits on one side of said fold and has another of said hole and two slits on the other side of said fold whereby, in use, each of the annular grooves snaps into engagement with a respective one of each of the holes.

4. A fastening system according to claim 3, wherein the stud is configured to be capable of passing, in use, through pre-punched holes in paper stationery located between the annular grooves in the stud.

5. A fastening system according to claim 1, wherein the stud is elongate and has an annular groove near each end, and the sheet of cover material is folded and has said hole and two slits on one side of said fold and has another of said hole and two slits on the other side of said fold whereby, in use, each of the annular grooves snaps into engagement with a respective one of each of the holes.

* * * * *